US008281933B2

(12) United States Patent
Grönvall et al.

(10) Patent No.: US 8,281,933 B2
(45) Date of Patent: Oct. 9, 2012

(54) RIDER BAR FOR SCREENING ELEMENT OR WEAR-RESISTANT LINING

(75) Inventors: Lars Grönvall, Trelleborg (SE); Niclas Hällevall, Södra Sandby (SE)

(73) Assignee: Metso Minerals (Wear Protection) AB, Trelleborg (SE)

( * ) Notice: Subject to any disclaimer, the term of this patent is extended or adjusted under 35 U.S.C. 154(b) by 388 days.

(21) Appl. No.: 11/793,205

(22) PCT Filed: Dec. 19, 2005

(86) PCT No.: PCT/SE2005/001954

§ 371 (c)(1), (2), (4) Date: Jun. 26, 2008

(87) PCT Pub. No.: WO2006/068590

PCT Pub. Date: Jun. 29, 2006

(65) Prior Publication Data

US 2008/0264832 A1 Oct. 30, 2008

Related U.S. Application Data

(60) Provisional application No. 60/638,500, filed on Dec. 23, 2004.

(30) Foreign Application Priority Data

Dec. 23, 2004 (SE) ..... 0403138

(51) Int. Cl.
*B07B 1/49* (2006.01)

(52) U.S. Cl. ..... 209/393; 209/392; 209/395; 209/399; 209/409

(58) Field of Classification Search ..... 209/392, 209/393, 395, 363, 409, 399
See application file for complete search history.

(56) References Cited

U.S. PATENT DOCUMENTS

| | | | | |
|---|---|---|---|---|
| 3,134,733 | A * | 5/1964 | Rose | 209/393 |
| 3,608,719 | A * | 9/1971 | Dehlen | 209/394 |
| 3,901,801 | A * | 8/1975 | Bixby | 209/395 |
| 3,980,555 | A * | 9/1976 | Freissle | 209/408 |
| 4,269,704 | A | 5/1981 | Bower, Jr. | |
| 4,986,900 | A * | 1/1991 | Mason | 209/397 |
| 2005/0000865 | A1 * | 1/2005 | Schulte et al. | 209/403 |
| 2009/0173595 | A1 * | 7/2009 | Burstrom | 193/25 E |

FOREIGN PATENT DOCUMENTS

| | | |
|---|---|---|
| AU | 501192 B2 | 6/1979 |
| DE | 2258123 | 5/1974 |
| EP | 520368 A | 6/1953 |

(Continued)

OTHER PUBLICATIONS

Metso Minerals, "Trellex Screening Media", Brochure No. 1259-01-02-WPC/Trelleborg-English, 2002, pp. 1-10.

(Continued)

*Primary Examiner* — Terrell Matthews
(74) *Attorney, Agent, or Firm* — Kinney & Lange, P.A.

(57) ABSTRACT

A rider bar (5) is essentially made of elastomeric material. The rider bar (5) is intended for a surface of a screen cloth (1) or a wear-resistant lining over which pieces or particles of material are intended to move. The rider bar (5) comprises a wear-resistant element (6).

10 Claims, 4 Drawing Sheets

FOREIGN PATENT DOCUMENTS

| | | | |
|---|---|---|---|
| EP | 0104458 | A2 | 4/1984 |
| FR | 2634148 | A3 | 1/1990 |
| GB | 2061124 | | 5/1981 |
| WO | WO 0145867 | | 6/2001 |
| WO | WO 0145867 | A1 * | 6/2001 |
| WO | WO 2006068590 | A1 * | 6/2006 |

OTHER PUBLICATIONS

SKEGA brochure.

REMA LOX brochure.

METSO Minerals, Trellex Screening Media, XP009145448, Jan. 1, 2002; retrieved from the Internet: URL:http://www.eurotim.hr/downlaod/METSO_S; p. 6.

Supplementary European Search Report in foreign counterpart Application No. EP05818911, dated Mar. 9, 2011.

* cited by examiner

RIDER BAR FOR SCREENING ELEMENT OR WEAR-RESISTANT LINING

FIELD OF THE INVENTION

The present invention relates to a rider bar essentially made of elastomeric material, intended for a surface of a screen cloth or a wear-resistant lining over which pieces or particles of material are intended to move.

BACKGROUND ART

There are a large number of known techniques which aim to reduce wear on screen cloths for screening machines adapted to separate a material bed into its different fractions. For instance, the brochure "Trellex siktmedia" (in English: Trellex screening media), published by the applicant in 2002, shows a "Trellex Panelcord". This known screen cloth, also called screen panel, comprises a substantially elastic cloth over which material is adapted to move. The cloth has through holes whose shape and dimension allow material fractions up to a certain size to fall through the cloth. To provide separation of fractions that is as efficient as possible, bars (referred to as "rider bars" or "skid bars") are integrated on the upper side of the cloth so that large fractions of material mainly slide or move over these bars. In this way, the direct contact of large fractions with the holes of the cloth will be reduced, or there will be no such direct contact at all, so that small fractions will more easily fall through the holes. The bars will also have the effect that the large fractions of the material bed exert less wear on the apertured portions of the cloth. The cloth and the bars are made as an integral unit of an elastomeric material, such as rubber or polyurethane.

A drawback of the cloth described above is that the material bed, especially the large fractions thereof, exerts considerable wear on the bars whose service life will thus be significantly shortened in relation to the other portions of the cloth. As a result, on the one hand the efficiency of the cloth is reduced and, on the other, the wear exerted by large fractions of material on the apertured portions of the cloth will occur earlier.

It is also known to provide a wear-resistant lining, also referred to as a wear-resistant plate, with rider bars to prevent large fractions of material from exerting wear on the surface of the lining but instead on the rider bar arranged on the same. Wear-resistant lining is used as a protective surface over which material is to pass and should, among other things, have as long an operative service life as possible. The drawback of the rider bars currently used on wear-resistant lining is that in relation to the other portions of the wear-resistant lining they have a considerably shorter service life.

There is thus a great need to reduce the load exerted by material on the rider bars arranged on the surface of a screen cloth or a wear-resistant lining.

Regarding prior-art technique, also the publications U.S. Pat. No. 4,269,704 and WO 01/45867 can be mentioned, which both disclose screens with rider bars arranged in parallel. The distance between these rider bars determines which fraction size in the material bed is screened, and the function of the rider bars corresponds to the holes of a screen cloth.

SUMMARY OF THE INVENTION

An object of the invention is to provide a rider bar, which is improved relative to prior art and which, arranged on a screen cloth or a wear-resistant lining, has an increased service life. At the same time it is an object to provide-cost-effective manufacture of a screen cloth or a wear-resistant lining provided with a rider bar improved according to the invention.

These and other objects that will appear from the following description are now achieved by a rider bar which is of the type described by way of introduction and which in addition has the features as defined in the characterising clause of claim 1, preferred embodiments being stated in the dependent claims.

The rider bar according to the invention is highly advantageous by having a considerably longer service life than a rider bar according to prior art. This is achieved by a wear-resistant element being arranged in the rider bar, so that large fractions of material substantially move over, and thus exert wear on, these wear-resistant elements. By the wear-resistant element being made of a more wear-resistant material than the elastomeric material of which the rider bar is made, a longer service life of the rider bar is achieved.

It is preferred to arrange the wear-resistant element along the entire length of the rider bar, thus protecting the whole rider bar.

The wear-resistant element is also suitably made of a ceramic material. Ceramic materials have good wear resistance to sliding wear and can easily be formed as desired.

The wear-resistant element can in an alternative embodiment be made of a material selected from the group consisting of steel, plastic and composite material. These materials can be given good resistance to wear.

The wear-resistant element is preferably partially embedded in the elastomeric material of the rider bar and is thus held in place with only the wear-resistant surface of the wear-resistant element visible at the upper edge of the rider bar. This results in an effective manufacturing process and a rider bar which effectively encloses and holds the wear-resistant element.

To make the wear-resistant element flexibly arranged in the rider bar so that the rider bar remains elastic, but also to minimise the risk of damage to the wear-resistant element in force absorption, the wear-resistant element advantageously consists of a plurality of neighbouring wear-resistant units arranged in a row along the rider bar.

The wear-resistant elements are suitably arranged so that they mechanically distribute between them the received load, thereby minimising the risk that the wear-resistant elements are damaged or broken. In addition, load is received by the wear-resistant elements with a dampening effect by the rider bar being made of an elastomeric material, which material can also constitute a layer between the wear-resistant elements for a greater dampening effect and, thus, further minimise the risk that the wear-resistant elements are damaged.

A variant of the design of the wear-resistant units to achieve the above-mentioned force distribution is to form the wear-resistant unit with a force-transferring portion and a force-receiving portion, and arrange the wear-resistant units aligned with each other, partially embedded in the rider bar, with the force-transferring portion of one wear-resistant unit neighbouring the force-receiving portion of the next wear-resistant unit. The force-transferring and force-receiving portions can by their geometry also function inversely, so that one and the same physical portion of the wear-resistant element can both transfer and receive force, depending on where on the rider bar and on which wear-resistant element load occurs. The form of the wear-resistant elements also results in a cost-effective manufacturing process by the wear-resistant elements easily being arranged along a line.

Another variant of the design of the wear-resistant units to achieve the above-mentioned force distribution to provide the wear-resistant unit with recesses for a force-distributing rod or wire. The wear-resistant units are then arranged aligned with each other along the rod or wire, in alignment with and partially embedded in the rider bar. This variant also results in a very simple and cost-effective manufacturing process by the wear-resistant elements easily being aligned with and secured to each other.

A further variant of the invention comprises a screen cloth of elastomeric material comprising at least one rider bar as described above, while another variant comprises a wear-resistant lining of elastomeric material comprising at least one rider bar as described above.

BRIEF DESCRIPTION OF THE DRAWINGS

The invention will in the following be described in more detail with reference to the accompanying drawings which by way of example illustrate a currently preferred embodiment of the invention.

DESCRIPTION OF PREFERRED EMBODIMENTS

Figure 1:
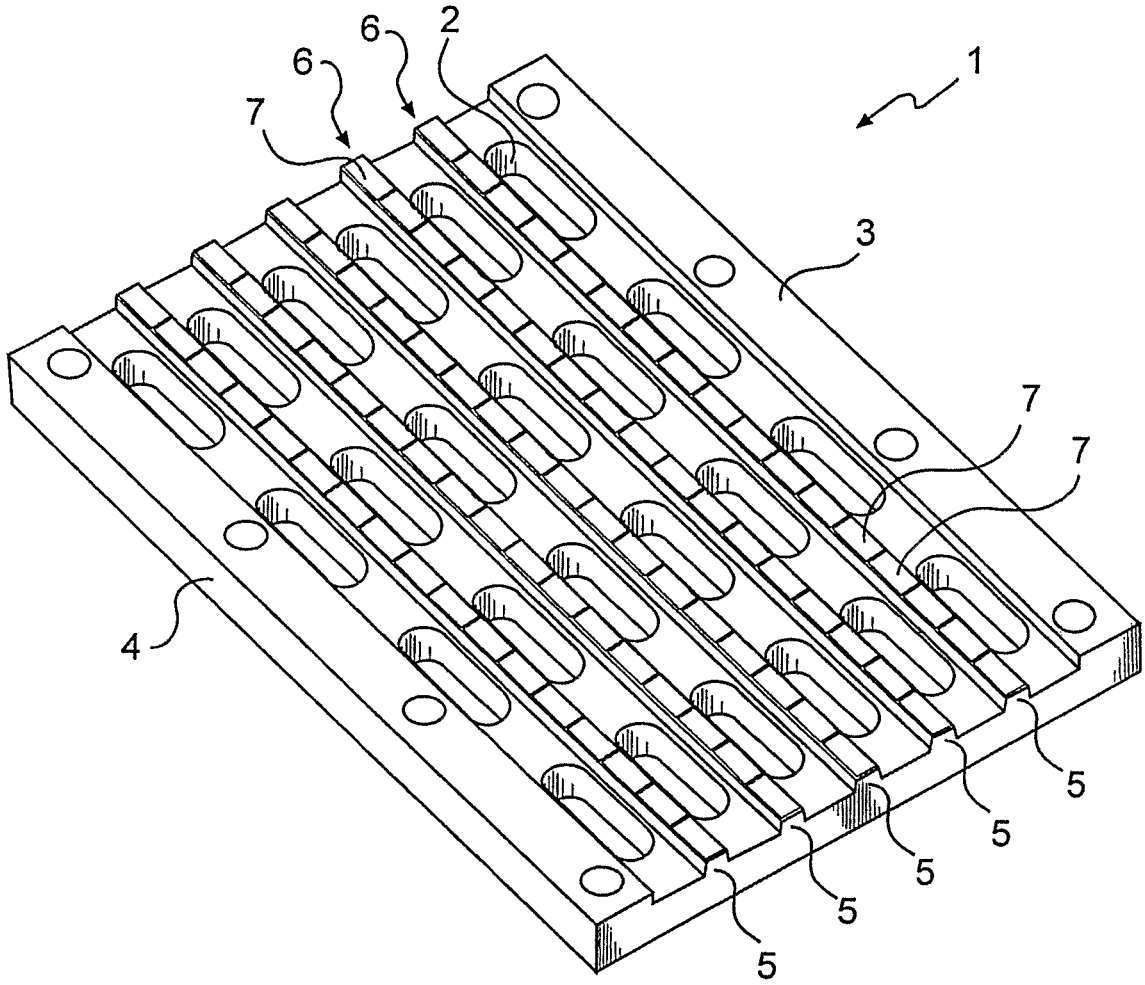
FIG. 1 is a perspective view of a screen cloth with rider bars according to the invention.
Figure 2C:
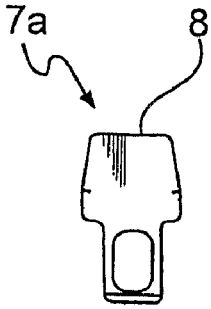
FIGS. 2*a-e* are perspective views and sectional views, respectively, of two embodiments of wear-resistant units designed to be mechanically secured to each other.
Figure 2A:
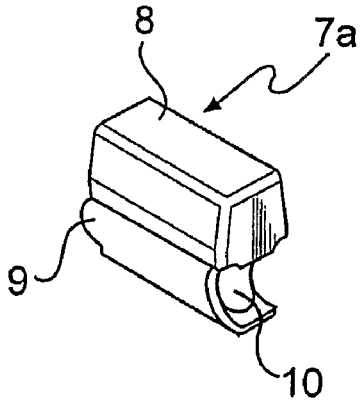
Figure 2B:
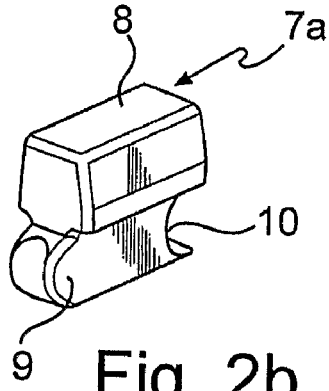
Figure 2E:
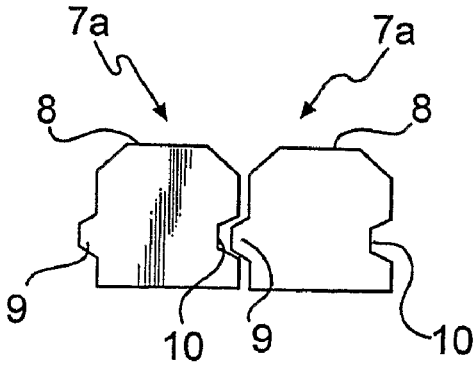
Figure 2D:
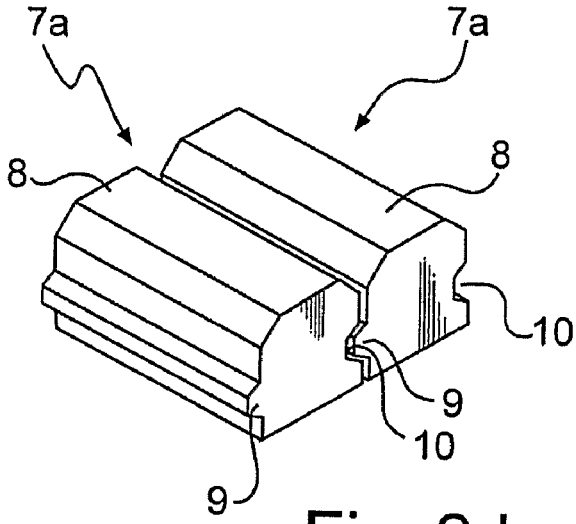

The screen cloth 1 shown in FIG. 1 has holes 2 to allow material fractions up to a certain size to fall through the same. Two long sides 3 and 4 of the cloth are formed to be attached to the screening machine, and rider bars 5 are arranged along the screen cloth. The screen cloth 1 and the rider bars 5 are both made of the elastomeric material polyurethane and are formed as an integral unit. The rider bars 5 extend along the entire length of the screen cloth 1 and parallel to the sides 3, 4 thereof. Moreover the rider bars 5 comprise wear-resistant elements 6 which are arranged along the entire length of each rider bar. Each wear-resistant element 6 consists of a number of smaller wear-resistant units 7 of ceramic material, and a thin layer of elastomeric material is arranged between the wear-resistant units 7 enclosed by the rider bar 5.

FIGS. 2*a-e* show two variants of wear-resistant units 7*a* adapted to be arranged by being mechanically secured to each other. The wear-resistant unit 7*a* has an upper side 8 intended to be in contact with a material bed moving over the screen cloth. A projecting portion 9 is formed on one side of the wear-resistant unit 7*a* and, on the opposite side, a recess 10 is formed, the shape of which corresponds to the projecting portion 9.

Figure 3B:
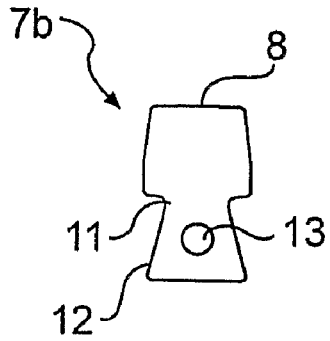
FIGS. 3*a-f* are perspective views and sectional views, respectively, of three embodiments of wear-resistant units designed to be secured along a reinforcing wire.
Figure 3A:
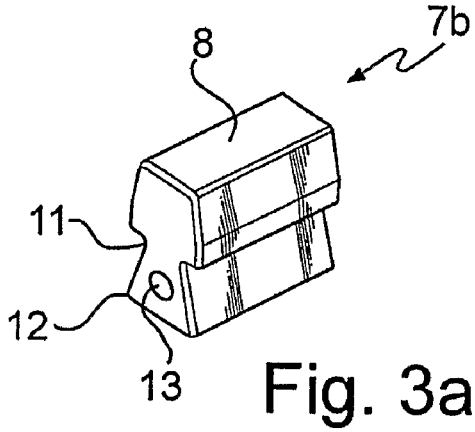
Figure 3D:
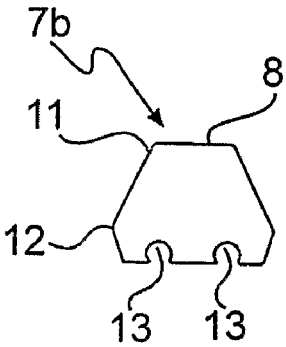
Figure 3C:
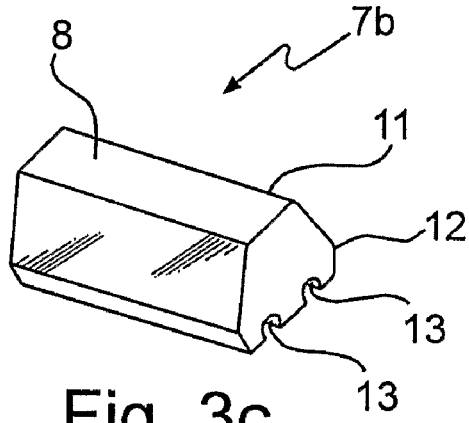
Figure 3F:
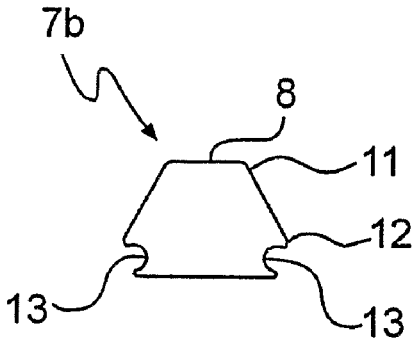
Figure 3E:
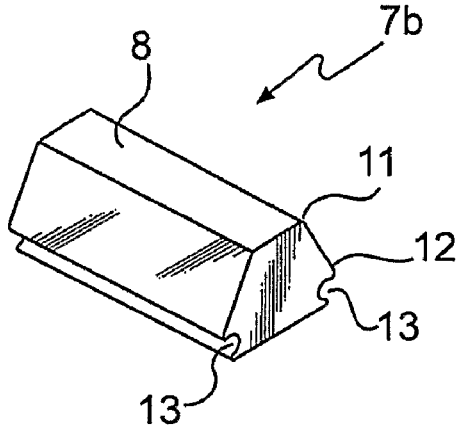

Three variants of wear-resistant units 7*b* adapted to be arranged by being secured along a reinforcing wire (not shown) are shown in FIGS. 3*a-f*. Each unit 7*b* has an upper side 8 adapted to be in contact with a material bed moving over the screen cloth. To provide improved securing when being embedded in the rider bar 5, the wear-resistant unit 7*b* has a narrower portion 11 above a wider portion 12. Recesses 13 for reinforcing wire are arranged, and it will be appreciated that the reinforcing wire within the scope of the present invention can be replaced by wire, rod or the like made of materials such as iron, steel, plastic, Kevlar etc. and can extend wholly or partly through the wear-resistant unit 7*b*. The recess 13 can be a through hole (FIG. 3*b*) or a longitudinal groove (FIGS. 3*d* and 3*f*).

Figure 4:
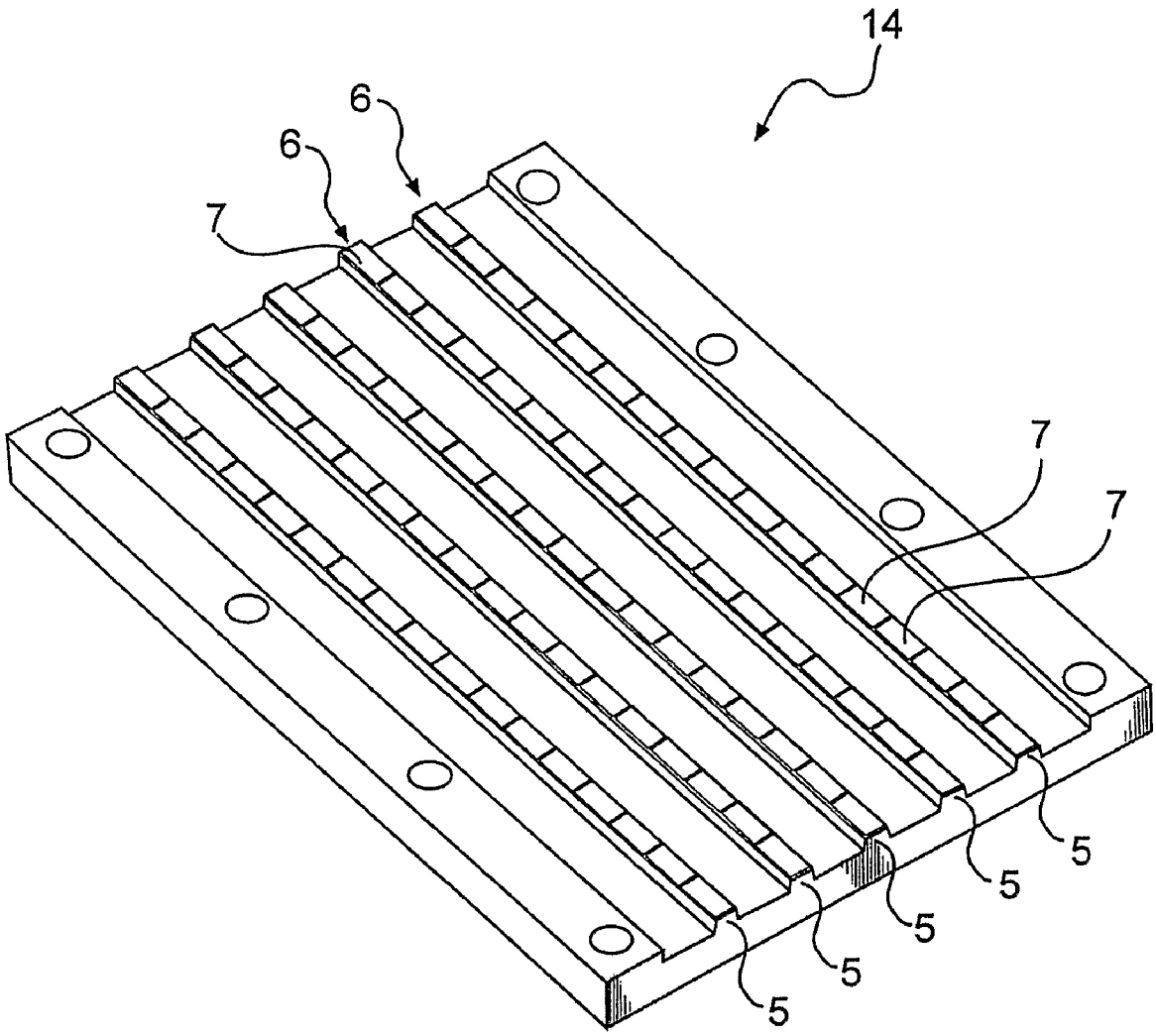
FIG. 4 is a perspective view of a wear-resistant lining element with rider bars according to the invention.

In the same way as the screen cloth 1 shown in FIG. 1, the wear-resistant lining element 14 in FIG. 4 is provided with rider bars 5 provided with wear-resistant elements 6 consisting of a plurality of wear-resistant units 7. The wear-resistant lining element 7 is made of polyurethane. The rider bars 5 are formed integrally with the wear-resistant lining element 14. Like in the case with the screen cloth 1, the wear-resistant units 7 can have different shapes in order to distribute forces between them. The wear-resistant lining element 7 can be provided with, for instance, wear-resistant units 7*a* of the type shown in FIGS. 2*a-e*, which by their form mechanically engage each other, or wear-resistant units 7*b* of the type shown in FIGS. 3*a-f*, which are slipped on to a reinforcing wire or the like.

It will be appreciated that many modifications of the above-described embodiments of the invention are conceivable within the scope of the invention, which is defined in the appended claims.

For example, the rider bar can wholly or partly be applied to a large number of screen cloths and wear-resistant linings, and it is also possible to vary the height of the rider bars on one and the same screen cloth so as to further distribute the wear exerted by large material fractions on different rider bars. It is also possible to apply the present invention to rider bars which are not integrated with the screen cloth or the wear-resistant lining, but instead are, for instance, secured by screws or by some other known technique arranged on the screen cloth or the wear-resistant lining.

It is also possible to make the rider bars shorter, more in number and angled in relation to the side of the screen cloth. It is also possible for only some rider bars or only selected portions of a rider bar to be provided with wear-resistant elements.

The wear-resistant elements can be made of other materials with higher wear resistance than the elastomeric material of which the rider bar is made, such as polycarbonate resin, steel, composite material and/or combinations thereof. It should also be noted that the wear-resistant element can be completely embedded in the rider bar, after which the wear-resistant element is gradually uncovered as the rider bar is being worn down. The wear-resistant element is suitably designed so that by its geometric shape it is held by the elastomeric material of which the rider bar is made.

Moreover several different forms of the projecting portion 9 and the recess 10 are conceivable, and it will be appreciated that the invention is not limited to the forms described and shown here. It will also be appreciated that the wear-resistant units can be arranged so as to hook into each other.

In the examples shown, the screen cloth 1 and the wear-resistant lining element 14 are made of polyurethane. However, it is also conceivable to use other elastomeric materials, such as natural rubber. Elastomeric material gives good shock absorption, while the wear-resistant elements give increased wear resistance in case of sliding wear.

As described above, the screen cloth 1 and the wear-resistant lining element 14 can advantageously be used to handle crushed stone materials, but, of course, they can also be used for pieces or particles of other materials that are to be screened or transported along a surface.

The invention claimed is:

1. A rider bar essentially made of elastomeric material, for a surface of a screen cloth or a wear-resistant lining over which pieces or particles of material are intended to move, characterised in that the rider bar comprises a wear-resistant element which is at least partially embedded in the rider bar and has an exposed upper side that contacts a material bed moving over the screen cloth, and wherein the wear-resistant element consists of a plurality of neighboring wear-resistant units.

2. A rider bar as claimed in claim 1, wherein the wear-resistant element extends along a length of the rider bar.

3. A rider bar as claimed in claim 1, wherein the wear-resistant element is made of a ceramic material.

4. A rider bar as claimed in claim 1, wherein the wear-resistant element is made of a material selected from the group consisting of steel, plastic and composite material.

5. A rider bar as claimed in claim 1, wherein the wear-resistant units are arranged to mechanically distribute received forces between them.

6. A rider bar as claimed in claim 5, wherein the wear-resistant unit has a force-transferring portion and a force-receiving portion, and that the wear-resistant units are aligned with each other, with the force-transferring portion of one wear-resistant unit neighbouring the force-receiving portion of the next wear-resistant unit.

7. A rider bar as claimed in claim 5, wherein the wear-resistant unit has recesses for a force-distributing rod or wire, and wherein the wear-resistant units are aligned with each other along the rod or wire.

8. A rider bar as claimed in claim 5, wherein the wear-resistant units engage each other.

9. A screen cloth of elastomeric material comprising at least one rider bar as claimed in claim 1.

10. A wear-resistant lining of elastomeric material comprising at least one rider bar as claimed in claim 1.

* * * * *

UNITED STATES PATENT AND TRADEMARK OFFICE

CERTIFICATE OF CORRECTION

PATENT NO. : 8,281,933 B2
APPLICATION NO. : 11/793205
DATED : October 9, 2012
INVENTOR(S) : Grönvall et al.

It is certified that error appears in the above-identified patent and that said Letters Patent is hereby corrected as shown below:

In the Specification

Col. 1, Line 18
Delete "Panelcord"
Insert --Panel-cord--

Col. 2, Line 66
Insert --is-- before "to provide the"

Signed and Sealed this
Twenty-sixth Day of November, 2013

Margaret A. Focarino

Margaret A. Focarino
*Commissioner for Patents of the United States Patent and Trademark Office*